US006938802B2

(12) United States Patent
Petit

(10) Patent No.: US 6,938,802 B2
(45) Date of Patent: Sep. 6, 2005

(54) DISPENSING PUMP FOR A FLUID PRODUCT

(75) Inventor: Ludovic Petit, Vitot (FR)

(73) Assignee: Valois S.A., LeNeubourg (FR)

( * ) Notice: Subject to any disclaimer, the term of this patent is extended or adjusted under 35 U.S.C. 154(b) by 152 days.

(21) Appl. No.: 10/114,988

(22) Filed: Apr. 4, 2002

(65) Prior Publication Data

US 2002/0175189 A1 Nov. 28, 2002

Related U.S. Application Data

(60) Provisional application No. 60/291,027, filed on May 16, 2001.

(30) Foreign Application Priority Data

Apr. 4, 2001 (FR) ..... 01 04594

(51) Int. Cl.[7] ..... B65D 88/54

(52) U.S. Cl. ..... 222/321.7; 222/321.9

(58) Field of Search ..... 222/321.7, 321.9, 222/321.2, 321.3, 321.1, 383.1, 380, 385, 382; 239/333, 331

(56) References Cited

U.S. PATENT DOCUMENTS 3,851,799 A * 12/1974 Paoletti ..... 222/129
4,056,216 A * 11/1977 Kotuby ..... 222/385
4,278,189 A * 7/1981 Kirk, Jr. ..... 222/321.2
4,437,588 A * 3/1984 Shay ..... 222/321.2
4,511,069 A 4/1985 Kalat
4,591,077 A * 5/1986 Corsette ..... 222/321.3
4,991,747 A * 2/1991 Van Brocklin ..... 222/321.3
5,409,146 A * 4/1995 Hazard et al. ..... 222/321.8
5,560,520 A * 10/1996 Grogen ..... 222/321.2
5,813,571 A * 9/1998 Gaucher ..... 222/95

FOREIGN PATENT DOCUMENTS

DE 28 38 613 3/1980
DE 2919686 A * 3/1981 ..... F04B/19/00
FR 1486392 10/1967

* cited by examiner

*Primary Examiner*—Frederick Nicolas
(74) *Attorney, Agent, or Firm*—Sughrue Mion, PLLC

(57) ABSTRACT

A dispensing pump for a fluid product, including a pump body (10) in which at least one piston (20, 30) slides, wherein a pump chamber (40) is defined between an input valve (50) and an output valve (60), and the pump body (10) extends towards the inside of a tank (2) through a plunger tube (70), the input valve (50) being sealably connected to the plunger tube (70), the pump having a return spring (5) which brings the pump back towards its rest position, and characterized in that the spring is positioned out of any contact with the fluid product.

20 Claims, 3 Drawing Sheets

DISPENSING PUMP FOR A FLUID PRODUCT

CROSS REFERENCE TO RELATED APPLICATION

This application claims the benefit under 35 U.S.C. §119 (e) of pending U.S. provisional patent application Ser. No. 60/291,027, filed May 16, 2001, and priority under 35 U.S.C. §119(a)–(d) of French patent application No. FR-01.04594, filed Apr. 4, 2001.

TECHNICAL FIELD

The present invention relates to a dispensing pump for a fluid product and to a dispensing device for a fluid product incorporating such a pump.

BACKGROUND OF THE INVENTION

As is known, a pump generally includes a pump body which defines a pump chamber usually positioned between an input valve and an output valve. In order to dispense the product contained in the pump chamber, the user actuates an actuating rod connected to a piston which slides in the pump body which generally causes the displacement of a second piston, called the low piston and which slides in a portion of the pump body with a reduced diameter until the output valve opens which causes the product contained in the pump chamber to be expelled under pressure. When the user lets go and the actuating rod moves back up to its rest position, under the action of a return spring, some product is sucked into the inside of the pump chamber through said input valve.

The object of the present invention is to overcome certain drawbacks which arise with the type of pump.

Thus, a drawback arises due to the relatively large dead space which exists upstream from the input valve of the pump chamber, in the flow direction of the product. Indeed, the plunger tube generally opens into the bottom of the pump body, so that this entire portion of the pump body which is located below the low piston and the input valve, is filled with product. This has the effect of inducing a non-negligible back pressure which makes the complete emptying of the tank difficult.

One of the objects of the present invention is to reduce the dead spaces and the back pressure of the pump.

The object of the present invention is also to improve priming of this type of pump, the latter generally requiring three or four actuation jolts of the pump before obtaining a completely filled pump chamber.

The object of the present invention is also to reduce the number of priming jolts required for priming the pump.

On the other hand, the return spring of the pump is generally mounted between the bottom of the pump bottom and the seat of the input valve which is floatably mounted inside said pump body. The spring is therefore in contact with the product, this may cause a certain number of problems when said spring is metal, as is often the case. The documents U.S. Pat. No. 4,511,069, FR-1 486 392 and DE-28 38 613 disclose such devices.

Another object of the present invention is to suppress any contact between the return spring of the pump and the product to be dispensed.

BRIEF SUMMARY OF THE INVENTION

Accordingly, the object of the present invention is a A dispensing pump for a fluid product, including a pump body in which at least one piston slides, wherein a pump chamber is defined between an input valve and an output valve, and said pump body extends towards the inside of a tank through a plunger tube said input valve being sealably connected to said plunger tube (70), the pump comprising a return spring which brings said pump back towards its rest position, characterized in that said spring is positioned out of any contact with the fluid product.

Advantageously, the pump body includes an upper aperture in which an actuating rod is assembled, and a lower aperture in which the plunger tube is assembled, wherein said pump body or said plunger tube includes, at said lower aperture of the pump body, a tubular portion axially extending towards the inside of the pump body, wherein said input valve is sealably connected to said tubular portion.

Advantageously, the input valve includes an input valve seat movable within said pump body and an input valve component, such as a ball, which selectively seals and opens said input valve, wherein said input valve seat includes, upstream from said input valve component in the flow direction of the product, an axial tube, one end of which sealably cooperates with said tubular portion of the pump body or plunger tube.

Advantageously, the return spring of the pump is positioned in the pump body between the seat of the input valve and the pump body or a component securely fixed to the pump body, such as a portion of the plunger tube.

Advantageously, said axial tube of the input valve seat sealably slides inside or outside of said tubular portion.

Advantageously, the input valve seat includes, upstream from the valve component, a radial through-hole for allowing the air contained in the pump chamber to be discharged towards the tank before the first actuation of the pump.

Advantageously, the output valve includes an output valve seat and an output valve component, wherein said output valve component includes an expended head cooperating with said output valve seat, wherein said output valve component is attracted to its closed position through the pressure of the product contained in the pump chamber, and is mechanically moved towards its open position at the end of the actuation stroke of the actuating rod.

The object of the present invention is also a dispensing device for a fluid product including a tank for the fluid product and a pump made as described above.

BRIEF DESCRIPTION OF THE DRAWINGS

Other features and advantages of the present invention will appear more clearly in the following detailed description of a particular embodiment of the latter, which will be made with reference to the appended drawings, given as non-limiting examples, and wherein.

DETAILED DESCRIPTION

Figure 3:
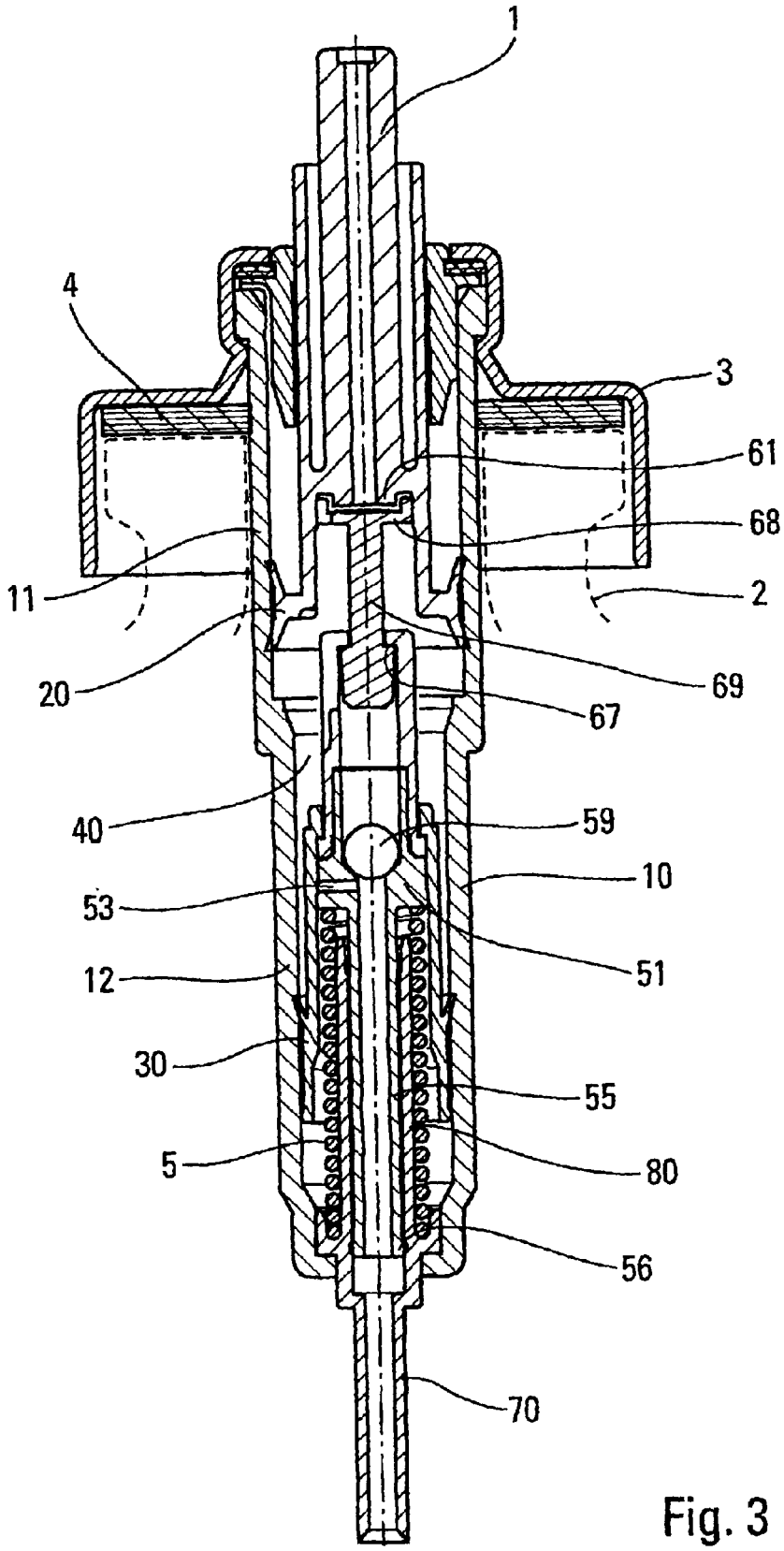
FIG. 3 is a similar view to that of FIGS. 1 and 2, in the actuating position of said pump.

Generally speaking, the present invention relates to a pump including a pump body 10 in which at least one piston 20, 30 slides, and in which a pump chamber 40 is defined between an input valve 50 and an output valve 60. An object of the invention is to directly and sealably connect said input valve 50 to the plunger tube 70 which is the extension of the pump body 10 inside a tank 2 (which is illustrated only very schematically in dotted-lines in FIG. 3). This sealed connection between the input valve 50 and the plunger tube limits the dead space of the product contained upstream from said input valve 50, which has the result of limiting back pressure, of facilitating priming of the pump, and of allowing the return spring 5 of the pump to be positioned away from any contact with the product to be dispensed.

The invention will now be more specifically described with reference to the particular embodiment illustrated in the drawings.

According to this advantageous embodiment, the pump includes a pump body 10 including an upper portion of a larger diameter 11 and a lower portion of a smaller diameter 12. The upper portion 11 includes an upper aperture in which an actuating rod 1 is assembled, connected to a first piston 20, called the high piston, which slides in said portion with a larger diameter 11 of the pump body. The lower portion 12 of the pump body includes a lower aperture in which a plunger tube 70 is assembled, and in which a second piston 30, called the low piston equally slides. A pump chamber 40 is defined between an input valve 50 and an output valve 60. The output valve 60 is formed at the level of the actuating rod 1, which defines the seat of the output valve 61, with which cooperates an output valve component 69. Advantageously, this valve component 69 is made as a rod provided with a radially expanded head 68, so that said output valve component 69 is pressed against the valve seat through the pressure of the product contained in the pump chamber 40 until said output valve component 69 is mechanically displaced away from said valve seat 61, at the end of the actuation stroke of the actuating rod 1. For this purpose, the valve component 69 includes a shoulder 67, which at the moment of the expulsion, cooperates with a part of the pump suitable for moving the latter with respect to its valve seat 61.

In the present patent application, the general operation of this pump will not be described in more detail, as this has already been done within the framework of a French patent application filed on Oct. 23rd 2000 by the same applicant (file number 00 13569).

The input valve is formed by a valve seat 51 and an input valve component 59, generally embodied as a ball. This ball may advantageously be made in glass or in plastic. The valve seat is floatably mounted inside the pump body and it cooperates with the low piston 30 so that it moves together with the latter when the pump is actuated. The valve seat 51 is stressed by the return spring of pump 5 which accordingly rests on said valve seat 51 on the one hand and on the other hand on the bottom of the pump body 10 or on a component 70 securely fixed to said bottom of the pump body.

According to one aspect of the invention, said input valve seat 51 is directly and sealably connected to the plunger tube 70. In the example illustrated in the figures, said input valve seat 51 includes, upstream from the input valve component 59 in the flow direction of the product, an axial tube 55 of a reduced size which extends towards the bottom of the pump body 10. Correspondingly, the pump body 10, or as illustrated in the figures, a component 70 fixed in the bottom of said pump body 10, includes a tubular portion axially extending towards the inside of the pump body. The lower end 56 of the axial tube 55 of the input valve seat 51 sealably cooperates with said tubular portion 80. In the examples illustrated in the figures, this tubular portion 80 is part of the plunger tube 70, but forming this tubular projection 80 directly in the bottom of the pump body 10 may perfectly be contemplated. Also, the lower end 56 of tube 55 sealably slides inside the tubular portion 80, but having this lower end of the tube 55 slide on the external wall of said tubular portion 80 may be contemplated.

The fact that tube 55 connected to the input valve 50 sealably cooperates with the plunger tube 70, results in that the return spring 5 may be positioned away from any contact with the product. This may notably be the case, if the tubular portion 80 is sealably assembled in the lower aperture of the pump body 10. This promotes the stability of the product when the spring is made in metal and, generally prevents all the problems encountered with metal springs. Thus, with a glass or plastic ball 59, the fluid product to be dispensed is no longer in contact with any metal component.

On the other hand, the internal dimensions of tube 55 and of the tubular portion 80 are significantly less than those for the pump body 10, the dead space of the pump is highly limited, as well as its back pressure. Actuation of the pump is therefore more reliable and the complete emptying of the tank is facilitated.

Figure 1:
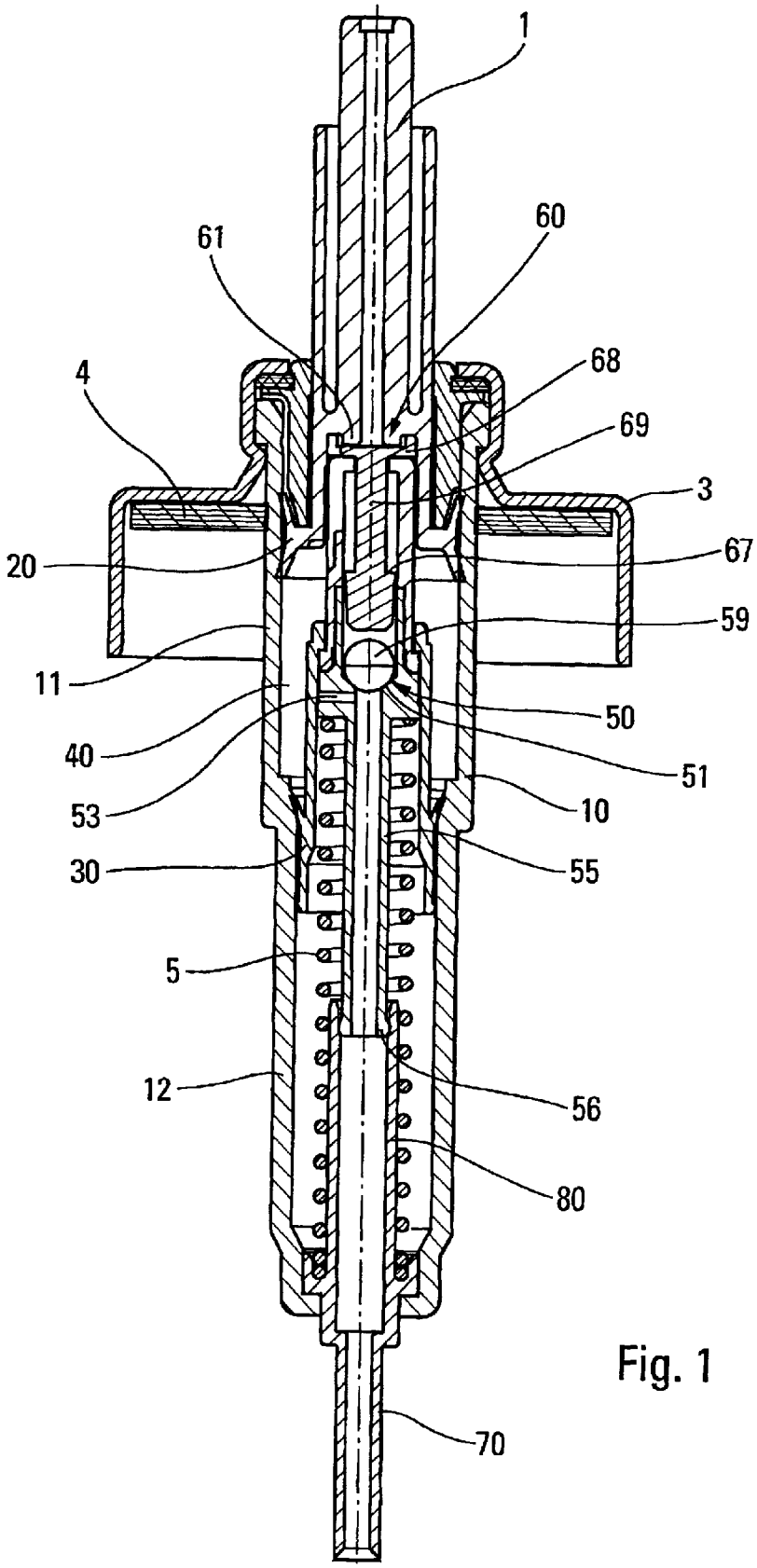
FIG. 1 is a schematic transverse sectional view of an advantageous embodiment of the present invention, in the rest position, before the first actuation of the pump.
Figure 2:
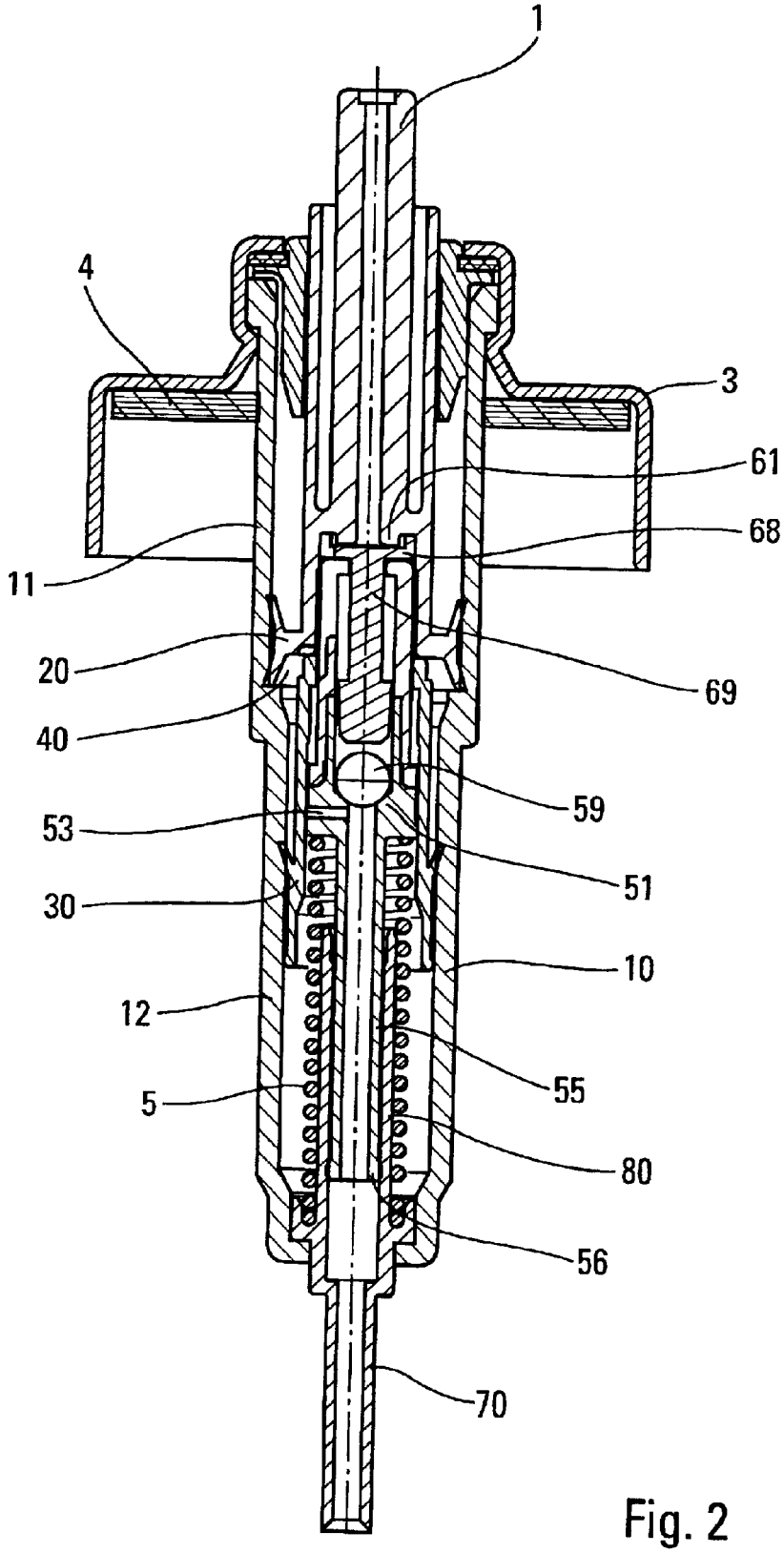
FIG. 2 is a similar view to that of FIG. 1, during the priming of said pump.

Because of the cooperative seal between the axial tube 55 of the input valve seat 51 and the tubular portion 80 of the plunger tube 70, a radial through-hole 53 is preferably provided upstream from the ball 59 of the input valve 50. Indeed, when the pump is primed, as illustrated in FIG. 2, air is compressed and does not escape through the output valve 60 of the pump which remains closed, but escapes towards the lower portion 12 of the pump body 10 by passing inside the low piston 30. As the input valve seat 51 sealably cooperates with the plunger tube 70 and said plunger tube 70 may be sealably mounted in the bottom of the pump body 10, provision of this radial air hole 53 is advantageous for allowing the air to escape through said plunger tube 70 towards the inside of the tank, during the priming of the pump. The priming is facilitated because of the smaller dead spaces formed by this direct connection between the plunger tube 70 and the input valve 50, so that the pump may operate after only one or two actuations of the latter.

The present invention was described with reference to a particular embodiment of the latter, but it is understood that various modifications may be made by one skilled in the art, without departing from the scope of the present invention as defined in the appended claims.

What is claimed is:

1. A dispensing pump for a fluid product, including a pump body (10) in which at least one piston (20, 30) slides, wherein a pump chamber (40) is defined between an input valve (50) and an output valve (60), and said pump body (10) extends towards the inside of a tank (2) through a plunger tube (70), said input valve (50) being sealably connected to said plunger tube (70), the pump comprising a return spring (5) which brings said pump back towards a rest position, wherein said spring is positioned out of any contact with the fluid product, and wherein the input valve (50) includes an input valve seat (51) movable within said pump body (10) and an input valve component (59), which selectively seals and opens said input valve (50); and wherein the pump body comprises an upper aperture in which an actuating rod is assembled, and a lower aperture in which the plunger tube is assembled.

2. The pump according to claim 1, wherein said pump body (10) or said plunger tube (70) includes at said lower aperture of the pump body (10), a tubular portion (80) axially extending inside the pump body (10), wherein said input valve (50) is sealably connected to said tubular portion (80).

3. The pump according to claim 2, wherein said input valve seat (51) includes, upstream from said input valve component (59) in the flow direction of the product, an axial tube (55), an end (56) of which sealably cooperates with said tubular portion (80) of the pump body (10) or plunger tube (70).

4. The pump according to claim 1, wherein the return spring (5) of the pump is positioned in the pump body (10) between the input valve seat (51) and the pump body or a component (70) securely fixed to the pump body (10).

5. The pump according to claim 3, wherein said axial tube (55) of the input valve seat (51) sealably slides inside said tubular portion (80).

6. The pump according to claim 3, wherein the input valve seat (51) includes, upstream from the valve component (59), a radial through-hole (53) for allowing air contained in the pump chamber (40) to be discharged towards the tank before the first actuation of the pump.

7. The pump according to claim 1, wherein the output valve (60) includes an output valve seat (61) and an output valve component (69), wherein said output valve component (69) includes an expanded head (68) cooperating with said output valve seat (61), wherein said output valve component (69) is attracted to a closed position through the pressure of the product contained in the pump chamber (40), and mechanically moved to an open position at the end of the actuation stroke of the actuating rod (1).

8. A dispensing device for the fluid product including a tank of the fluid product, characterized in that the dispensing device includes a pump according to claim 1.

9. A dispensing pump according to claim 1, wherein the input valve component is a ball.

10. The pump according to claim 1, wherein the return spring (5) of the pump is positioned in the pump body (10) between the input valve seat (51) and a portion of the plunger tube securely fixed to the pump body.

11. The pump according to claim 1, wherein the spring is disposed outside the pump chamber.

12. The pump according to claim 1, wherein the actuating rod slides axially within the upper aperture in a same direction as the at least one piston.

13. The pump according to claim 12, wherein the upper aperture is above the at least one piston and pump chamber.

14. The pump according to claim 13, further comprising a second piston disposed below the at least one piston.

15. The pump according to claim 1, wherein the actuating rod is above the pump chamber.

16. A dispensing pump for a fluid product, including a pump body (10) in which at least one piston (20, 30) slides, wherein a pump chamber (40) is defined between an input valve (50) and an output valve (60), and said pump body (10) extends towards the inside of a tank (2) through a plunger tube (70) of said input valve (50) being sealably connected to said plunger tube (70), the pump comprising a return spring (5) which brings said pump back towards a rest position, wherein said spring is positioned out of any contact with the fluid product, and wherein the output valve (60) includes an output valve seat (61) and an output valve component (69), wherein said output valve component (69) includes an expanded head (68) cooperating with said output valve seat (61), wherein said output valve component (69) is attracted to a closed position through the pressure of the product contained in the pump chamber (40), and mechanically moved to an open position at the end of the actuation stroke of the actuating rod (1); and wherein the pump body comprises an upper aperture in which the actuating rod is assembled, and a lower aperture in which the plunger tube is assembled.

17. The pump according to claim 16, wherein the spring is disposed outside the pump chamber.

18. The pump according to claim 16, wherein the actuating rod slides axially within the upper aperture in a same direction as the at least one piston and wherein the upper aperture is above the at least one piston and pump chamber.

19. The pump according to claim 18, further comprising a second piston disposed below the at least one piston.

20. The pump according to claim 16, wherein the actuating rod is above the pump chamber.

* * * * *